US010490334B2

(12) United States Patent
Prand-Stritzko

(10) Patent No.: US 10,490,334 B2
(45) Date of Patent: Nov. 26, 2019

(54) COIL FORMER FOR AN ELECTRICAL COIL ASSEMBLY AND METHOD FOR PRODUCING AN ELECTRICAL COIL ASSEMBLY

(71) Applicant: EGSTON SYSTEM ELECTRONICS EGGENBURG GMBH, Eggenburg (AT)

(72) Inventor: Ernst Prand-Stritzko, Langau (AT)

(73) Assignee: EGSTON SYSTEM ELECTRONICS EGGENBURG GMBH, Eggenburg (AT)

( * ) Notice: Subject to any disclaimer, the term of this patent is extended or adjusted under 35 U.S.C. 154(b) by 0 days.

(21) Appl. No.: 15/777,507

(22) PCT Filed: Nov. 17, 2016

(86) PCT No.: PCT/EP2016/077961
§ 371 (c)(1),
(2) Date: May 18, 2018

(87) PCT Pub. No.: WO2017/085169
PCT Pub. Date: May 26, 2017

(65) Prior Publication Data

US 2018/0336989 A1 Nov. 22, 2018

(30) Foreign Application Priority Data

Nov. 20, 2015 (AT) ..... 50992/2015

(51) Int. Cl.
*H01F 27/06* (2006.01)
*H01F 27/10* (2006.01)
(Continued)

(52) U.S. Cl.
CPC ..... *H01F 27/10* (2013.01); *H01F 5/02* (2013.01); *H01F 27/06* (2013.01); *H01F 27/28* (2013.01);
(Continued)

(58) Field of Classification Search
CPC ..... H01F 27/00–36
(Continued)

(56) References Cited

U.S. PATENT DOCUMENTS 3,605,055 A 9/1971 Grady
5,175,525 A 12/1992 Smith
(Continued)

FOREIGN PATENT DOCUMENTS

EP 1193391 4/2002
FR 2 502 836 10/1982
(Continued)

OTHER PUBLICATIONS

International Search Report issued by the European Patent Office in International Application PCT/EP2016/077961 dated Jan. 13, 2017.
(Continued)

*Primary Examiner* — Tuyen T Nguyen
(74) *Attorney, Agent, or Firm* — CKC & Partners Co., LLC

(57) ABSTRACT

The invention relates to a coil former (1) for an electrical coil assembly (2), wherein the coil former (1) has a winding-holding region (3) for at least one peripheral segment of a coil winding (4), which winding-holding region (3) is bounded by a winding-holding region inner surface (5) for contact with an innermost winding layer (6) of the coil winding (4) and at least one first end piece (7) protruding from the winding-holding region inner surface (5). According to the invention, an at least partially surrounded fluid-holding reservoir (9) is arranged on a side of the first end
(Continued)

piece (7) facing away from the winding-holding region (3), the fluid-holding reservoir (9) is connected to the winding-holding region (3) by a fluid passage opening (10), and the fluid passage opening (10) is arranged adjacent to the winding-holding region inner surface (5).

3 Claims, 4 Drawing Sheets

(51) Int. Cl.

| | |
|---|---|
| ***H01F 5/02*** | (2006.01) |
| ***H01F 27/32*** | (2006.01) |
| ***H01F 41/12*** | (2006.01) |
| ***H01F 27/28*** | (2006.01) |
| ***H01F 41/06*** | (2016.01) |

(52) U.S. Cl.
CPC ..... *H01F 27/327* (2013.01); *H01F 41/06* (2013.01); *H01F 41/127* (2013.01); *H01F 27/325* (2013.01)

(58) Field of Classification Search
USPC ..... 336/65, 90, 192, 196, 198
See application file for complete search history.

(56) References Cited

U.S. PATENT DOCUMENTS

| | | | | |
|---|---|---|---|---|
| 5,898,354 | A * | 4/1999 | Lee | H01F 27/022 336/192 |
| 6,201,463 | B1 * | 3/2001 | Yamashita | H01F 27/324 336/198 |
| 6,332,458 | B1 * | 12/2001 | Shimada | H01F 41/064 123/634 |
| 6,771,157 | B2 * | 8/2004 | Nishikawa | H01F 3/14 336/178 |
| 8,450,900 | B2 | 5/2013 | Prand-Stritzko | |
| 2004/0113735 | A1 * | 6/2004 | Takeyama | F02P 3/02 336/90 |

FOREIGN PATENT DOCUMENTS

| | | |
|---|---|---|
| JP | S56 83916 | 7/1981 |
| JP | H10144516 | 5/1998 |

OTHER PUBLICATIONS

Austrian Search Report dated Nov. 14, 2016 issued by the Austrian Patent Office in counterpart Austrian patent application A 50992/2015.

Translation of Austrian Search Report dated Nov. 14, 2016 issued by the Austrian Patent Office in counterpart Austrian patent application A 50992/2015.

* cited by examiner

COIL FORMER FOR AN ELECTRICAL COIL ASSEMBLY AND METHOD FOR PRODUCING AN ELECTRICAL COIL ASSEMBLY

CROSS-REFERENCES TO RELATED APPLICATIONS

This application is the U.S. National Stage of International Application No. PCT/EP2016/077961, filed Nov. 17, 2016, which designated the United States and has been published as International Publication No. WO 2017/085169 and which claims the priority of Austrian Patent Application, Serial No. A 50992/2015, filed Nov. 20, 2015, pursuant to 35 U.S.C. 119(a)-(d).

BACKGROUND OF THE INVENTION

The invention relates to a coil former.

In coils from the field of electrical engineering, arranging the actual coil winding on an insulating material part, which is referred to as the coil former, is known. Such a coil former assists the winding procedure in that it helps, for example, the positioning of the individual windings of the coil winding and helps the intended shape of the coil to be maintained more exactly. Furthermore, the coil former electrically insulates the coil winding, in the case of coils which are arranged on a magnetic core or simple core, at least regionally in relation to the core, and during the winding of the coil winding protects the core from the mechanical stresses, which can result in worsening of the magnetic properties of the core.

Of course, cavities between the coil winding and the core and/or the coil former may hardly be avoided. These worsen the heat transfer from the coil winding into the core and represent a limiting factor with respect to the permissible power loss of the coil assembly. Filling these intermediate spaces using a curable potting compound is therefore furthermore known. This often takes place in the scope of a so-called trickle process, in which the otherwise finished coil assembly is arranged such that a part of the outermost winding layer is directly accessible from above. Liquid potting compound is subsequently applied drop by drop onto this outermost winding layer. The distribution of the potting compound through the coil winding takes place due to capillary action and gravity.

In order to fill as many intermediate spaces as possible in such a process, it is carried out until the potting compound drips off again already at the lower end of the coil assembly, and also an appropriately thin and/or low-viscosity potting compound is selected. It is disadvantageous that the process of trickling is very time-consuming and dirty. The trickling itself is already time-consuming, since only small quantities of the potting compound can be applied at a time, and therefore it is necessary to wait between each two drops. Since the intermediate spaces of the coil winding are to be filled as completely as possible by the potting compound, a potting compound has to be selected which has a long curing time and low viscosity, in order to assist the most complete possible penetration of the coil winding. This has the result that all coil assemblies have to be set aside over a longer period of time after the filling of the coil winding, in order to enable drying of the potting compound. Moreover, the circumstance that trickling has to be performed until the potting compound drips out or from the coil again has the result that the region in which this process step takes place is soiled by the dripping potting compound. Therefore, separate areas are required for the trickle process and also the subsequently required drying.

Alternatively thereto, a higher-viscosity potting compound can also be selected, whereby it is possible to avoid dripping potting compound soiling the work environment. However, such a potting compound does not penetrate all cavities, whereby there are regions of the coil in which no potting compound is arranged, with the corresponding disadvantages with respect to the heat dissipation.

The viscosity of the potting compound is dependent in this case in a manner known per se on the processing temperature.

SUMMARY OF THE INVENTION

The object of the invention is therefore to specify a coil former of the type mentioned at the outset, using which the mentioned advantages can be avoided, and using which the formation with simple manufacturing of a coil assembly having a high thermal capacity is assisted.

According to one aspect of the invention, the object is achieved by a coil former for an electrical coil assembly, wherein the coil former has a winding receptacle region for at least one circumferential section of a coil winding, which winding receptacle region is delimited by a winding receptacle region inner surface for contact with an innermost winding layer of the coil winding and at least one first end piece protruding from the winding receptacle region inner surface, wherein an at least regionally enclosed fluid receptacle reservoir is arranged on a side of the first end piece facing away from the winding receptacle region, the fluid receptacle reservoir is connected by a fluid passage opening to the winding receptacle region, and the fluid passage opening is arranged adjoining the winding receptacle region inner surface.

The formation of a coil assembly having a high thermal capacity can thus be assisted. Due to the fluid receptacle reservoir and the fluid passage opening, the potting compound or the fluid can be conveyed directly to the region which is decisive for the thermal capacity of the coil assembly, namely between the innermost winding layer of the coil winding and the coil former or an optional core, respectively. It can thus be ensured that this region is completely penetrated by the fluid, without it being necessary for this purpose to introduce so much fluid into the coil assembly that it runs out. The relevant workspace is thus not soiled. A separate region or space can thus be omitted. In the present coil former, the total quantity of required fluid can furthermore be dispensed into the fluid receptacle reservoir in a single metering procedure, without further metering being necessary, whereby the processing time can be substantially reduced. Furthermore, a very thin potting compound can be used, without an escape of potting compound from the coil and the corresponding soiling occurring in this case.

Due to the reliable and complete filling of the intermediate spaces in the inner winding layers, the heat dissipation inward can be improved or ensured, whereby such a coil assembly can be operated with higher power loss, without overheating or being thermally damaged. This is advantageous in particular in the case of coils having a core and/or a cooling unit arranged in the interior thereof.

The invention further relates to a method for producing an electrical coil assembly.

The object of the invention is therefore to specify a method for producing an electrical coil assembly, using which the disadvantages mentioned at the outset can be avoided, and using which a coil assembly having a high thermal capacity can be formed with simple manufacturing.

According to this aspect of the invention, the object is achieved by a for producing an electrical coil assembly, wherein at least one coil winding is wound at least regionally around a coil former, as set forth above, wherein a coil axis of the coil winding is arranged substantially parallel to the fluid passage opening of the coil former, wherein subsequently the fluid passage opening is positioned substantially vertically, wherein subsequently a first quantity of a curable fluid is poured into the fluid receptacle reservoir, wherein subsequently the fluid is cured.

The above-mentioned advantageous effects can thus be achieved.

The dependent claims relate to further advantageous embodiments of the invention.

Reference is hereby expressly made to the wording of the patent claims, whereby the claims are incorporated at this point by reference into the description and are considered to be reproduced verbatim.

BRIEF DESCRIPTION OF THE DRAWING

The invention will be described in greater detail with reference to the appended drawings, in which preferred embodiments are illustrated merely by way of example. In the figures.

DETAILED DESCRIPTION OF PREFERRED EMBODIMENTS

Figure 1:
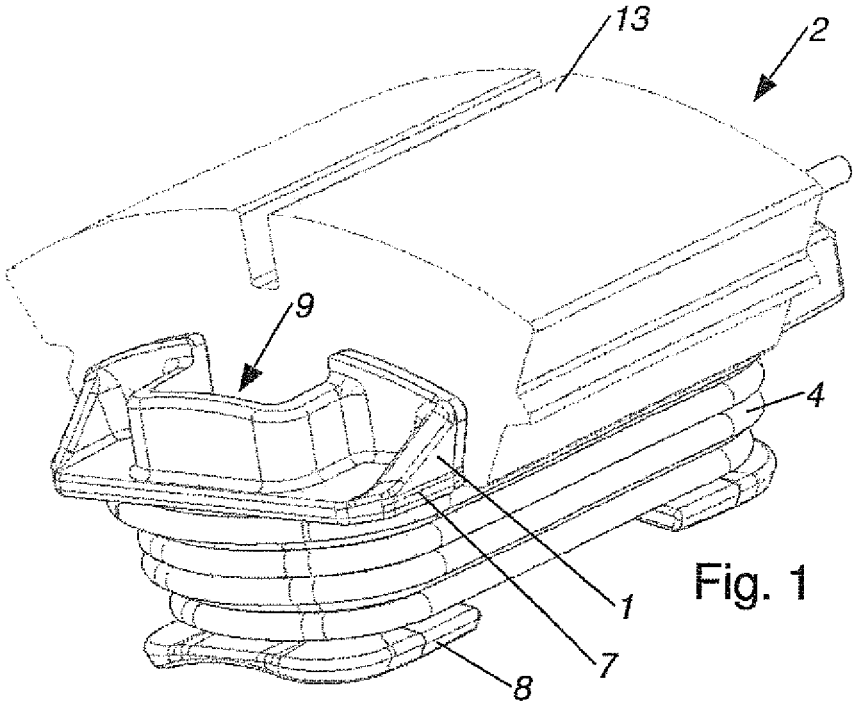
FIG. 1 shows a first embodiment of an electrical coil assembly having a first embodiment of a coil former in a first axonometric illustration.
Figure 2:
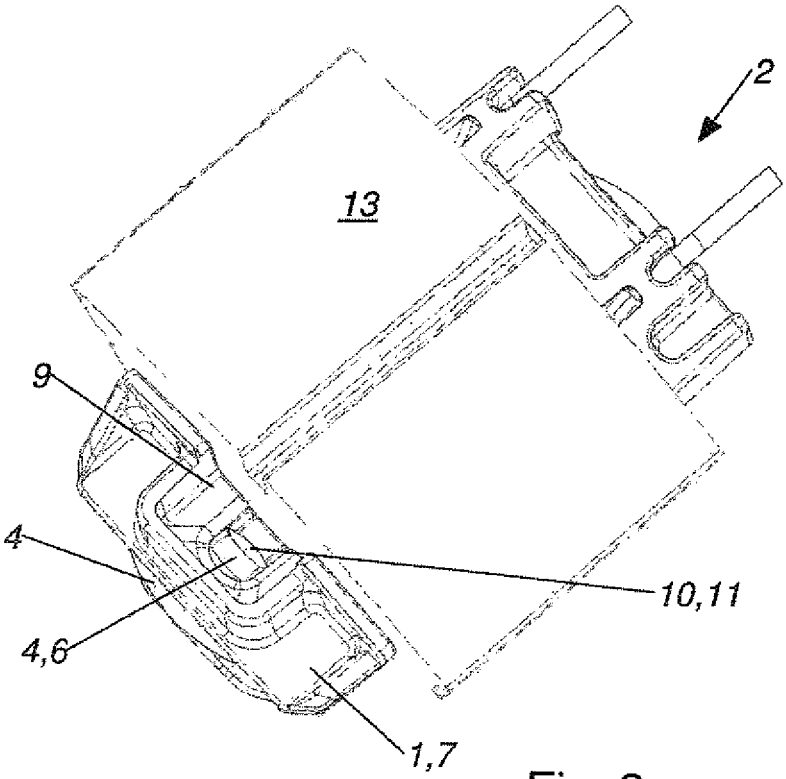
FIG. 2 shows the coil assembly according to FIG. 1 in a second axonometric illustration.

FIGS. 1 to 8 each show an electrical coil assembly 2 or parts of such a coil assembly comprising at least one core 13 and at least one coil winding 4, which coil winding 4 is wound around at least one region of the coil 13, wherein a coil former 1 is arranged on at least one circumferential section of the core 13 between the core 13 and the coil winding 4, wherein the coil former 1 has a winding receptacle region 3 for at least one circumferential section of the coil winding 4, which winding receptacle region 3 is delimited by a winding receptacle region inner surface 5 for contact with an innermost winding layer 6 of the coil winding 4 and at least one first end piece 7 protruding from the winding receptacle region inner surface 5, wherein, on a side of the first end piece 7 facing away from the winding receptacle region 3, an at least regionally enclosed fluid receptacle reservoir 9 is arranged, wherein the fluid receptacle reservoir 9 is connected by a fluid passage opening 10 to the winding receptacle region 3, wherein the fluid passage opening 10 is arranged adjoining the winding receptacle region inner surface 5, wherein the fluid passage opening 10 of the coil former 1 is arranged substantially parallel to a coil axis 15.

The formation of a coil assembly 2 having a high thermal capacity can thus be assisted. The potting compound or the fluid can be conveyed directly by the fluid receptacle reservoir 9 and the fluid passage opening 10 to the region which is decisive for the thermal capacity of the coil assembly 2, namely between the innermost winding layer 6 of the coil winding 4 and the coil former 1 or an optional coil 13, respectively. It can thus be ensured that this region is completely penetrated by the fluid, without it being necessary for this purpose to introduce so much fluid into the coil assembly 2 that it runs out. The relevant workspace is thus not soiled. A separate region or space can thus be omitted. In the present coil former 1, the entire quantity of required fluid can furthermore be dispensed into the fluid receptacle reservoir 9 in a single metering procedure, without later metering being necessary, whereby the processing time can be substantially reduced. Furthermore, a very thin potting compound can be used, without an escape of the potting compound from the coil assembly 2 and the corresponding soiling occurring.

Due to the reliable and complete filling of the intermediate spaces in the inner winding layers 5, the heat dissipation inward can be improved or ensured, whereby such a coil assembly can be operated with high power loss, without overheating or being thermally damaged. This is advantageous in particular in coil assemblies 2 having a core 13 and/or a cooling unit arranged in the interior thereof.

The present invention relates to the field of at least regionally potted coil assemblies 2. The potting takes place in this case using a curable fluid, such as an artificial resin. Corresponding fluids or resins or potting compounds are known per se.

A present coil assembly 2 can be formed with or without core 13. The present embodiments illustrated in FIGS. 1 to 8 of a present coil assembly each have a core 13, wherein it can also be provided, however, that a coil assembly 2 does not have a magnetically active core. Such coils are also referred to as air-core coils, even if they have a plastic core, for example. Furthermore, guiding a liquid cooling unit through the coil assembly 2 instead of or together with the illustrated core 13 can be provided.

The present coil former 1 can also be referred to as a coil insulating body or as a winding head. The coil former 1 is preferably formed as an insulating material part, in particular as a plastic injection-molded part.

The coil former 1 has a winding receptacle region 3 for at least one circumferential section of a coil winding 4. In the first embodiment according to FIGS. 1 to 4, it is provided that the relevant coil winding 4 is only arranged with a small circumferential section in the winding receptacle regions 3 of the two coil formers 1. In contrast, it is provided in the second embodiment of a coil former 1 according to FIGS. 5 to 8 that the relevant coil winding 4 is arranged substantially completely inside the winding receptacle region 3.

The winding receptacle region 3 has a winding receptacle region inner surface 5, on which—in the case of a coil winding 4 arranged on the coil former 1—the innermost winding layer 6 of the coil winding 4 presses and/or is arranged adjacent thereto.

The winding receptacle region inner surface 5 is delimited by at least one protruding first end part 7, which is preferably formed as a first end disk, wherein conical or differently-shaped end pieces 7, 8 can also be provided, however. The winding receptacle region inner surface 5 is preferably delimited on a side facing away from the first end piece 7 by a second end piece 8. The present device part referred to as the end piece 7, 8 is also referred to as a winding flange.

A fluid receptacle reservoir 9 is arranged on a side of the first end piece 7 facing away from the winding receptacle region 3. The fluid receptacle reservoir 9 is at least regionally enclosed in this case, in particular by walls, which are preferably formed integrally with the remaining coil former 1.

The fluid receptacle reservoir 9 can essentially have an arbitrary cross section and an arbitrary height, wherein cross section and height can have an influence on the draining behavior of the fluid, however, and can be adapted accordingly to the further shape of the coil body.

According to the preferred embodiments, the fluid receptacle reservoir 9 is enclosed on at least three sides, wherein according to the first embodiment, an enclosure in the form of three walls arranged substantially perpendicularly to one another is provided, and according to the second embodiment, a circumferentially closed enclosure in the form of a cylinder segment lateral surface and a planar surface adjoining thereon is provided. In the case of a fluid receptacle reservoir 9 open on one side, it is provided that it is closed by the core 13 or another component arranged on the inside, as soon as the coil former 1 comes into contact with the core 13, for example, as in the embodiments according to FIGS. 1 to 4.

The fluid receptacle reservoir 9 is connected by a fluid passage opening 10 to the winding receptacle region 3. The fluid passage opening 10 arranged in the first end piece 7 is arranged adjoining the winding receptacle region inner surface 5 in this case. A fluid poured into the fluid receptacle reservoir 9 therefore flows through the fluid passage opening 10 along the winding receptacle region inner surface 5 into the winding receptacle region 3. In this case, the fluid arrives directly in the region of the innermost layer of the coil winding 4, which—if the coil assembly 2 is formed comprising a core 13—arranged closest to the core 13.

In operation, electrical current flows directly through the coil winding 4, whereby power loss in the form of heat arises directly in the coil windings 4, and it heats up. Since the coil winding 4 itself is the heat source, it heats up very rapidly and above all more rapidly than components which are in contact with the coil winding 4. The coil winding 4 accordingly emits heat to the surroundings, wherein if a core 13 is present, heat is emitted above all thereto. The core 13 generally has a substantially higher mass than the coil winding 4 itself, and moreover in many electromechanical and/or electromagnetic apparatuses is in direct contact with a heat exchanger, such as a heat sink or a liquid cooling unit. The primary cooling of the coil winding 4 therefore takes place by heat dissipation into the core 13 or a cooling unit arranged at this point, because of which the region between the winding receptacle region inner surface 5 and the innermost windings or winding layers 6 of the coil winding 4 has particular significance in the heat dissipation. Due to the present arrangement of the fluid passage opening 10, the fluid is poured in directly where it is most important for later operation of the coil assembly 2. It can thus be ensured that this region is actually substantially completely filled by the fluid, and such that a lower heat transfer resistance from the coil winding 4 to the core 13 is achieved.

Figure 3:
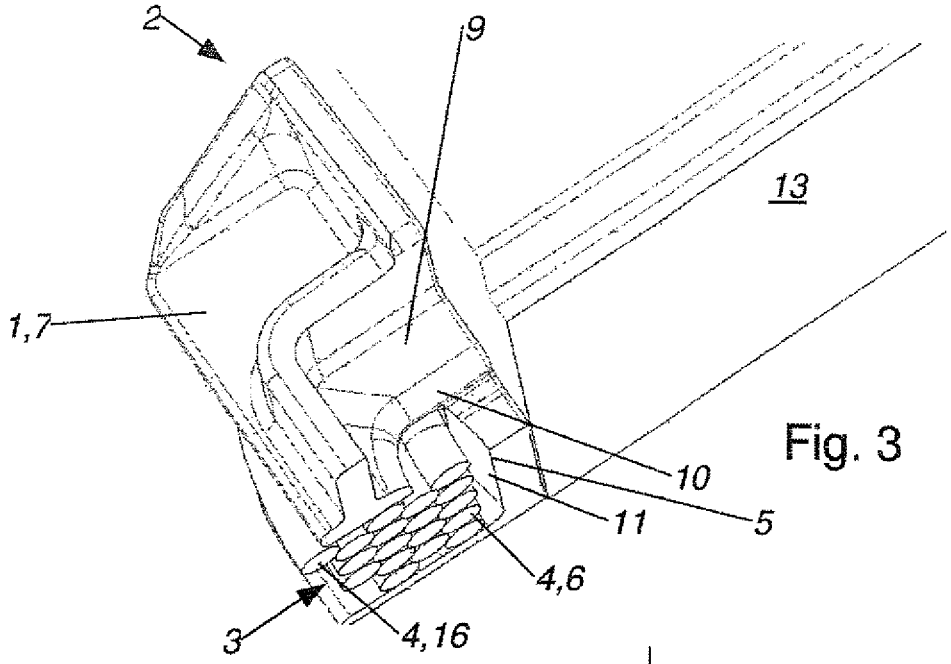
FIG. 3 shows a detail of the coil assembly according to FIG. 1 in a sectional view in a third axonometric illustration.
Figure 4:
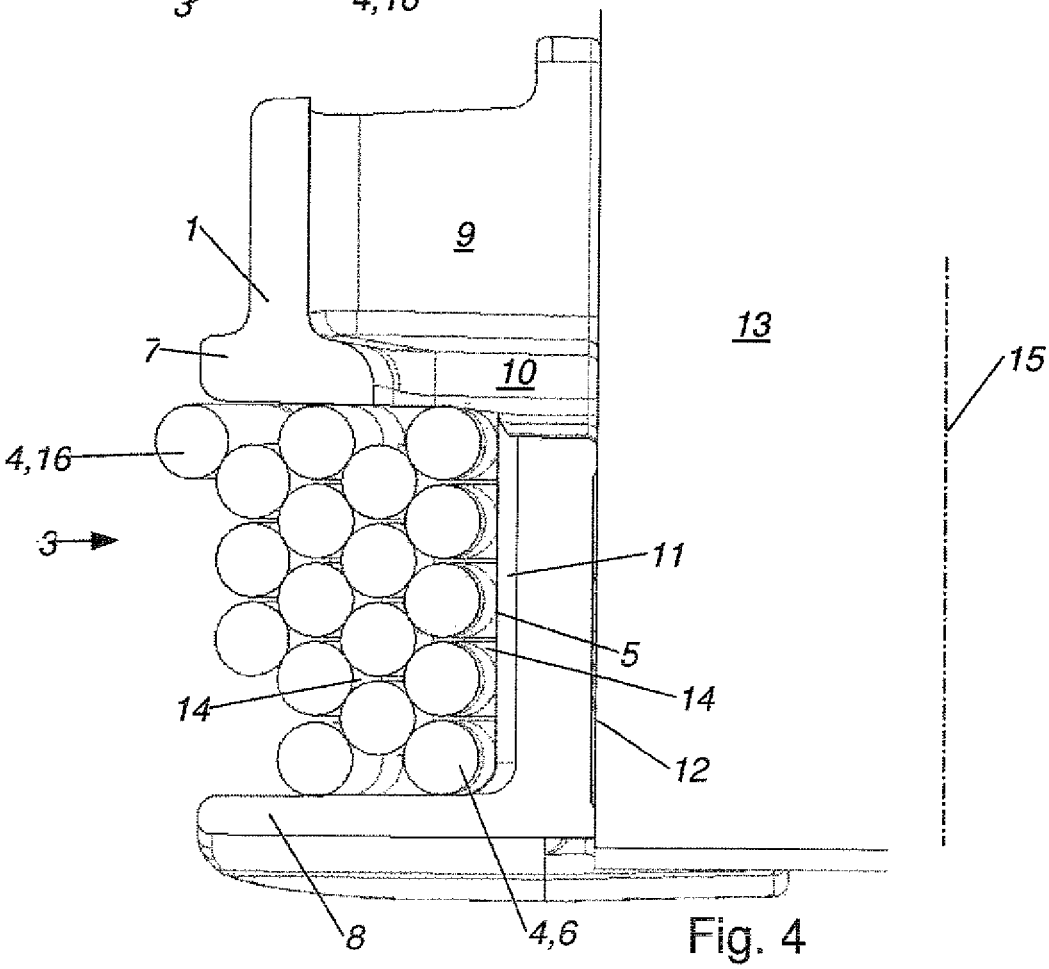
FIG. 4 shows the section according to FIG. 3 in outline.
Figure 5:
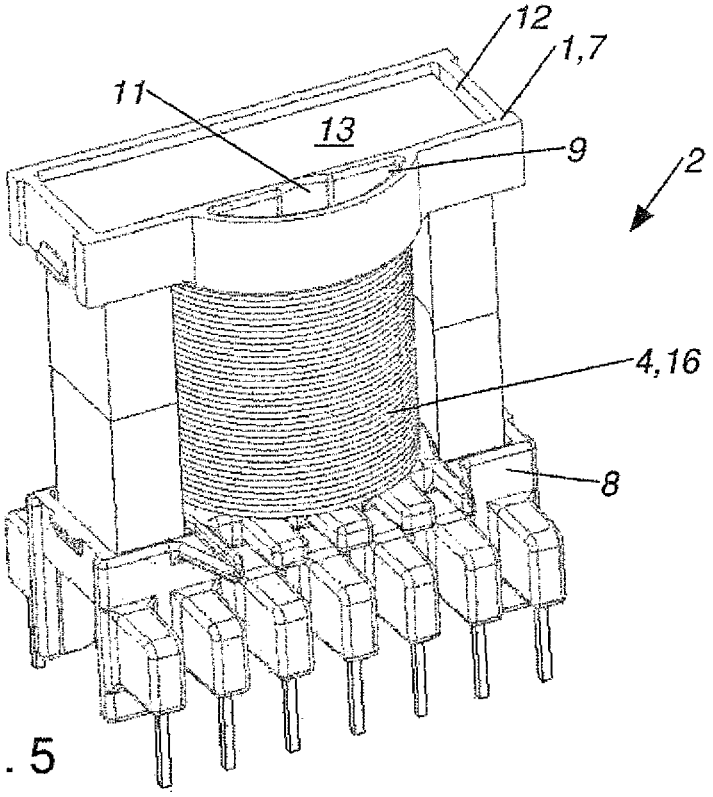
FIG. 5 shows a second embodiment of an electrical coil assembly having a second embodiment of a coil former in a first axonometric illustration.
Figure 6:
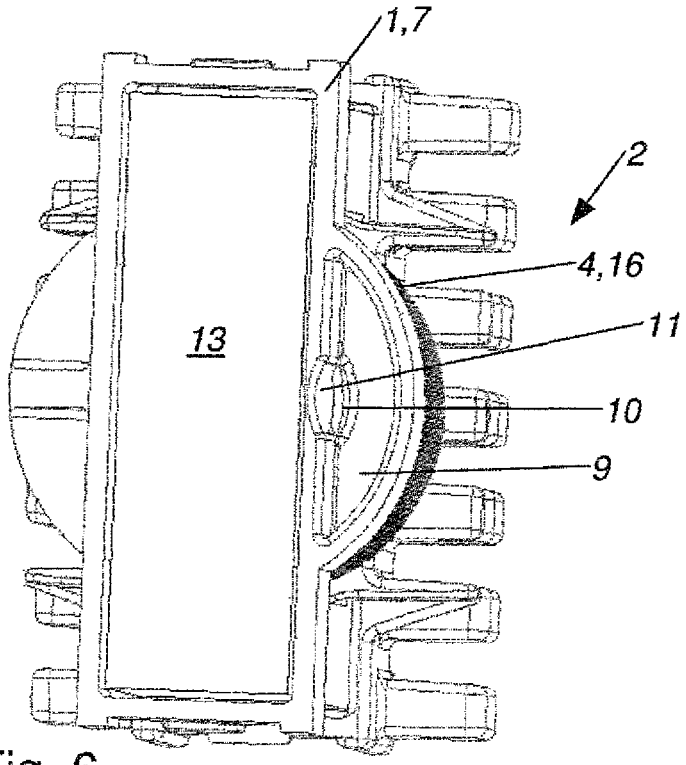
FIG. 6 shows the coil assembly according to FIG. 5 in a second axonometric illustration.
Figure 7:
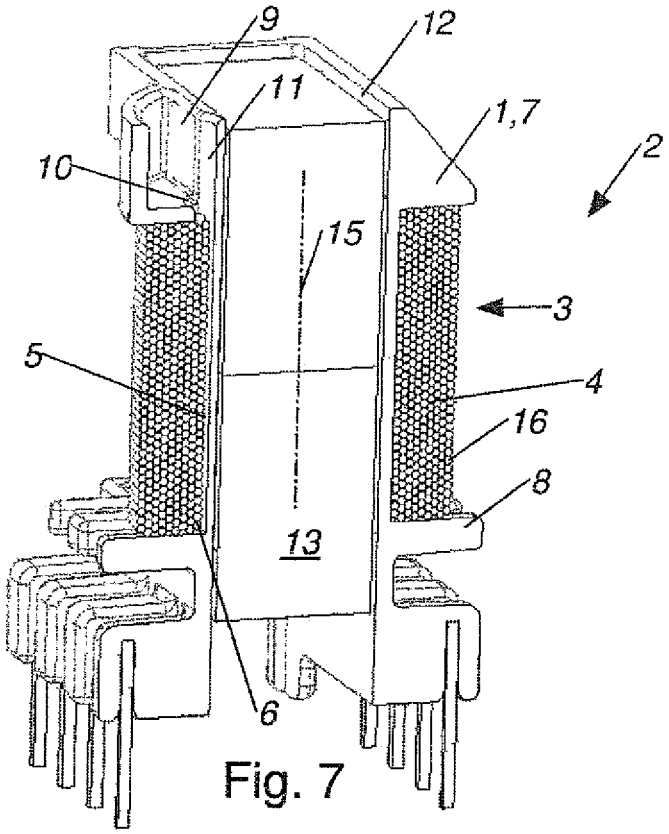
FIG. 7 shows the coil assembly according to FIG. 5 in a sectional view in a third axonometric illustration.
Figure 8:
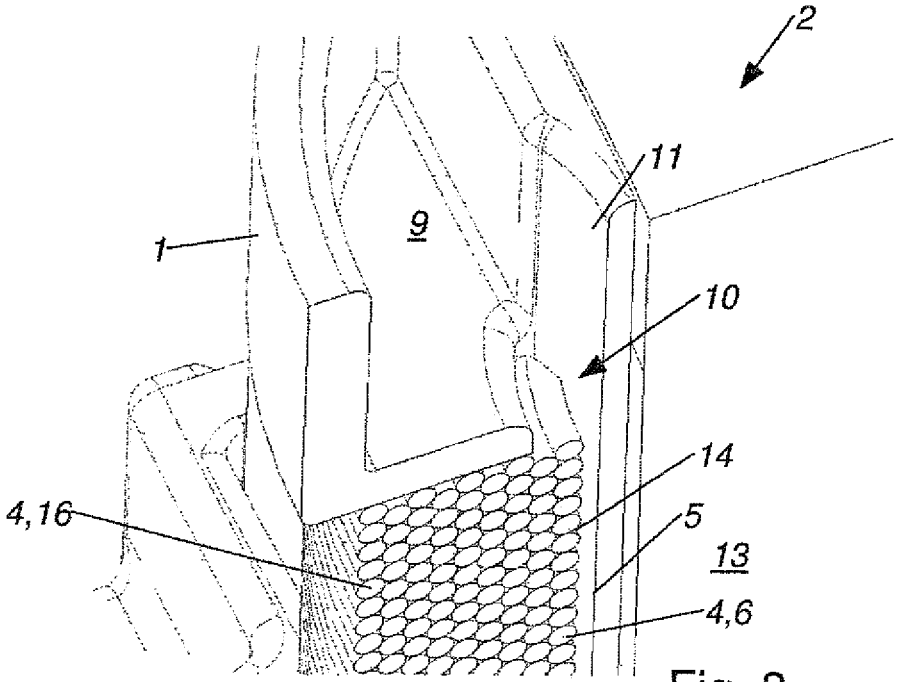
FIG. 8 shows a detail of the sectional view according to FIG. 7 in a fourth axonometric illustration.

Depending on the coil winding 4 and coil former 1, a certain distance exists between the winding receptacle region inner surface 5 and the innermost winding layer 6. This gap simplifies the pouring of the fluid into the intermediate spaces of the coil winding 4. The resulting width or size of the relevant distance can also be very small, however, since it is a goal of the winding procedure per se for the individual winding layers 6 to press as closely as possible to the winding receptacle region inner surface 5. According to one preferred refinement of the present invention, it is provided that a fluid channel 11 is arranged or formed in the receptacle region inner surface 5, and the fluid passage opening 10 arranged in the first end piece 7 is arranged adjacent to the fluid channel 11. The fluid channel 11 is preferably formed as an in particular flat channel open on one side, as shown in FIGS. 3 and 8, for example. By means of the fluid channel 11, the penetration of the fluid into the coil winding 4 and the intermediate space 14 between coil winding 4 and core 13 can be accelerated.

The fluid channel 11 is preferably arranged essentially in the middle of the winding receptacle region inner surface 5. The greatest distance between the winding receptacle region inner surface 5 and the innermost winding layer 6, which is typically to be encountered in this region, can thus be used to further accelerate the penetration of the fluid into the coil winding 4.

It is preferably provided that a present coil assembly 2 is operated together with a core 13 or a magnetic core. Such cores 13 are well-known in conjunction with electrical coil assemblies 2. It is therefore preferably provided that the coil former 1 has a core receptacle region 12 on a side facing away from the winding receptacle region 3. It is either provided in this case that the coil former 1 is arranged on a core 13, or the core 13 is arranged inside the coil former 1.

The preferred embodiments of the invention are described hereafter together with a core, wherein—as already described—coil assemblies 2 without core 13 can also be provided, however, for example, so-called air-core coils or coils, on which a part of a cooling unit is arranged in the region in which a core 13 can be arranged. In coil assemblies 2 without core 13, either the coil receptacle region 12 on the coil former 1 can be omitted, or it can be used to receive another component, for example, a part of a cooling device.

FIGS. 1 to 8 each show an electrical coil assembly 2 having a core 13 or coil core and at least one coil winding 4, which coil winding 4 is wound around at least one region of the core 13, wherein a present coil former 1 is arranged on at least one circumferential section of the core 13 between the core 13 and the coil winding 4.

A cured fluid is preferably arranged in intermediate spaces 14 between and/or adjoining individual turns of the coil winding 4, wherein the fluid is arranged in particular on the innermost winding layer 6 of the coil winding 4 arranged closest to the core 13, whereby the heat dissipation from the coil winding 4 can be assisted.

The fluid passage opening 10 of the coil former 1 is arranged substantially parallel to a coil axis 15 and/or substantially normal to a circumferential direction of the at least one conductor of the coil winding 4. This type of the arrangement of the coil winding 4 in relation to the fluid passage opening 10 or the fluid receptacle reservoir 9 assists the distribution of the fluid in the course of the pouring procedure. The fluid flowing in via the fluid passage opening 10 is conducted through the turns and free spaces of the coil winding 4 extending transversely to the flowing-in direction, and flows further along the turns and free spaces of the coil winding 4, whereby the fluid is conducted around the entire coil winding 4.

The above-described effect is further assisted if—as is preferably provided—at least one winding layer 6, 16 of the coil winding 4 is formed substantially fluid-tight, wherein it is preferably provided that the innermost winding layer 6 is already formed fluid-tight. In the embodiment according to FIGS. 1 to 4, the fluid-tightness is achieved between the innermost winding layer 6 and the winding layer adjoining thereon.

The coil winding 4 can be formed in one layer or multiple layers, wherein it is preferably provided that the coil winding 4 is formed as a multilayer coil winding 4, wherein it can be provided in particular that the coil winding 4 is a conical coil winding 4. In such a coil winding 4 it is necessary for the conductor of the coil winding 4 to cross or jump over underlying turns of the coil winding 4 at least once. It is preferably provided that the coil winding 4 is formed without intersections in the region of the fluid passage opening 10, whereby the distribution of the fluid inside the coil winding 4 can be improved, and a fluid exit and thus soiling of the surroundings can be prevented.

The fluid-tightness results in multilayered coil windings 4, in particular in so-called stepped coil windings, from a preferably provided orthocyclic winding picture, but is also possible with other winding pictures. In particular in coil windings 4 which are wound from a thin wire and have a high number of winding layers 6, a fluid-tightness can also be achieved with a so-called wild winding picture.

FIGS. 1 to 4 show a first embodiment of an electrical coil assembly 2 having a first embodiment of a coil former 1. The coil assembly 2 is formed in this case as a partial segment of a stator of an electric motor.

A coil former 1 is arranged on each of the end faces on the core 13, wherein one of the two coil formers 1 is formed as a present coil former 1 comprising a fluid receptacle reservoir 9 and a fluid passage opening 10.

This coil former 1 has a winding receptacle region 3, which is bordered on one side by a web, which bears the winding receptacle region inner surface 5, and on which the first end piece 7 and the second end piece 8 are formed. The two end pieces 7, 8 are formed substantially flat toward the winding receptacle region 3. The first end piece 7 has, in addition to the delimitation walls of the fluid receptacle reservoir 9, furthermore stiffening ribs and a stop bracket, with which the coil former 1 presses against the coil 13.

FIGS. 5 to 8 show a second embodiment of an electrical coil assembly 2 having a second embodiment of a coil former 1. The coil assembly 2 is part of a transformer, a choke, or a magnetic coil in this case.

The coil former 1 according to the second embodiment is formed such that it both encloses the entire core 13 of the coil assembly 2, and simultaneously receives all of the coil windings 4. The fluid receptacle reservoir 9 is arranged on the upper side in the form of a cylindrical segment enclosed on all sides by parts of the coil former 1 having the fluid passage opening 10. The coil former 1 according to the second embodiment has the basic form of a cuboid having end disks.

In a method for producing an electrical coil assembly 2 having a present coil former 1 and a core 13, it is provided that the at least one coil former 1 is arranged on the core 13. The at least one coil winding 4 is subsequently wound around the coil former 1 on at least one part of the coil 13. The coil winding 4 is wound in this case around the core 13 or the coil former 1 such that the coil axis 15 of the coil winding 4 is arranged substantially parallel to the fluid passage opening 10 of the coil former 1. Subsequently, the fluid passage opening 10 is positioned substantially vertically, by the entire coil assembly 2 existing up to this point being positioned such that the fluid passage opening 10 is arranged in said location. It is particularly preferably provided in this case that the coil assembly 2 is formed such that it is possible to set it aside, and the fluid passage opening 10 is also arranged in said location when the coil assembly 2 is set aside. It is thus possible to set aside the coil assembly 2 and to fill it with the fluid in this state.

Of course, a production of a coil assembly 2 without core 13 is possible and provided according to the present method, wherein the method step of arranging the core 13 inside the coil former 1 is omitted.

After the coil assembly 2 has been aligned appropriately, a first quantity of a curable fluid is poured into the fluid receptacle reservoir 9, whereupon the fluid reaches the coil winding 4 through the fluid passage opening 10. It is particularly preferably provided in this case that in a metering step, the entire fluid quantity is supplied, so that no later metering is required. Of course, the fluid receptacle reservoir 9 has to be formed correspondingly large in this case, to receive such a fluid quantity.

In addition to the dispensing of the entire fluid quantity in a single metering step, it can be advantageous, for example, for processing, to pour the fluid quantity in multiple individual doses into the fluid receptacle reservoir 9. By dividing this process step into a sequence of individual steps, an adaptation to a predefined process cycle can take place.

The fluid is subsequently cured, for example, in that the coil assembly 2 is set aside in a room, which is possibly temperature-controlled or climate-controlled.

According to one particularly preferred refinement of this method, it is provided that a process temperature and a viscosity of the fluid are selected such that the fluid gels upon reaching an outermost winding layer 16 of the coil winding 4. The fluid can thus no longer be capable of dripping upon exiting from the coil winding 4. The consumption of fluid can thus be kept low, and at the same time soiling can be prevented.

The invention claimed is:

1. A coil former for an electrical coil assembly, comprising:

a winding receptacle region for at least one circumferential section of a coil winding, said winding receptacle region being delimited by a winding receptacle region inner surface for contact with an innermost winding layer of the coil winding, a first end piece protruding from the winding receptacle region inner surface at an upper end thereof, and a second end piece protruding from the winding receptacle region inner surface at a lower end thereof; and an at least regionally enclosed fluid receptacle reservoir arranged on a side of the first end piece facing away from the winding receptacle region, said fluid receptacle reservoir being connected to the winding receptacle region by a fluid passage opening which adjoins the winding receptacle region inner surface, wherein the winding receptacle region inner surface includes a fluid channel extending along a height of the winding receptacle region from the directly adjoining fluid passage opening to the second end piece such that the fluid channel is open only on one side adjoining said fluid passage opening, wherein fluid poured into the fluid receptacle reservoir flows through the fluid passage opening along the winding receptacle region inner surface into the winding receptacle region, wherein the fluid channel accelerates penetration of fluid into the coil winding and intermediate spaces of the coil winding.

2. The coil former of claim 1, wherein the fluid channel is arranged essentially in the middle in the winding receptacle region inner surface.

3. The coil former of claim 1, further comprising a core receptacle region on a side facing away from the winding receptacle region.

* * * * *